US007786821B2

(12) United States Patent
Carter et al.

(10) Patent No.: US 7,786,821 B2
(45) Date of Patent: Aug. 31, 2010

(54) COMPACT END LAUNCH TRANSITION INCLUDING A BODY WITH AN ANTENNA AND AN ELECTRICAL CONNECTOR

(75) Inventors: Paul Andrew Carter, York (GB); Stephen Roy Chandler, York (GB)

(73) Assignee: BSC Filters Ltd., Osbaldwick, York (GB)

( * ) Notice: Subject to any disclaimer, the term of this patent is extended or adjusted under 35 U.S.C. 154(b) by 73 days.

(21) Appl. No.: 12/131,797

(22) Filed: Jun. 2, 2008

(65) Prior Publication Data

US 2009/0295494 A1 Dec. 3, 2009

(51) Int. Cl.
*H01P 5/103* (2006.01)

(52) U.S. Cl. ..... 333/26; 333/33

(58) Field of Classification Search ..... 333/26, 333/33

See application file for complete search history.

(56) References Cited

U.S. PATENT DOCUMENTS 4,999,592 A * 3/1991 Kanda et al. ..... 333/26
5,258,727 A * 11/1993 DuPuis et al. ..... 333/26
5,359,339 A * 10/1994 Agrawal et al. ..... 343/786
6,987,429 B2 * 1/2006 Shih et al. ..... 333/26

FOREIGN PATENT DOCUMENTS

GB 2 338 607 12/1999

* cited by examiner

*Primary Examiner*—Benny Lee
(74) *Attorney, Agent, or Firm*—Beyer Law Group LLP

(57) ABSTRACT

A compact end launch transition for providing a connection between a housing having an electrical terminator and a waveguide component and associated method are described. The transition includes a having a rear side presenting a substantially flat surface to abut the housing and has a front side having an aperture. An antenna located within the body is configured to interact with the aperture to form an end launch transition. An electrical connector is in electrical communication with the antenna and exposed from the rear side of the body to connect directly to the electrical terminator. This avoids the need to use cable to connect the housing and waveguide component and provides a particularly compact device.

44 Claims, 5 Drawing Sheets

COMPACT END LAUNCH TRANSITION INCLUDING A BODY WITH AN ANTENNA AND AN ELECTRICAL CONNECTOR

FIELD OF THE INVENTION

The present invention relates to a connector and in particular a connector for connecting an electrical device and an electromagnetic waveguide component.

DESCRIPTION OF RELATED ART

There are a number of applications in which it is desirable to be able to couple an electrical signal from an electrical device to an electromagnetic waveguide component. For example, in the field of telecommunications it can be necessary to connect an electrical amplifier in a base station to a microwave waveguide so as to couple the electrical signal from the amplifier into the waveguide or some other microwave component.

One approach is to use a length of co-axial cable terminated with a SMA connector which connects between a SMA connector providing the output signal from the electrical device and another SMA connector of the waveguide component. For example, GB 2338607 describes a waveguide end launch transition having a SMA connector to which a co-axial cable can be attached. However, there is often very little space within electrical housings, or in their environment, and there may not be space for the co-axial cable or SMA connector, or the co-axial cable or connector may hinder access. Hence, there is a need for a mechanism which can be used to couple between an electrical device and a waveguide component in confined spaces.

SUMMARY OF THE INVENTION

The present invention provides a connector which allows an electromagnetic waveguide component to be directly connected to an electrical device without the need of an ancillary coupling device. The invention allows an electrical device and waveguide component to be connected in a compact manner.

The invention provides a compact waveguide end launch transition for connecting a housing having an electrical terminator and a waveguide component. The transition can include a body. The body can have a rear side or surface which presents at least a portion of a substantially flat surface to abut the housing. The body can also have a front side having an aperture formed therein. An antenna can be located within the body and can be configured to interact with the aperture to form an end launch transition. An electrical connector can be provided in electrical communication with the antenna and exposed from the rear side of the body to connect directly to the electrical terminator.

It has been found that the waveguide transition connector of the invention has several advantages. In particular, it is possible with the invention to provide electrical communication between an electrical termination of a housing and a waveguide component using a relatively compact device. The compactness of the invention has several advantages. One advantage is that the connection between a housing and a waveguide component can be achieved in a relatively small space. Another advantage is a reduction in parasitic electrical interference which occurs in a connector of an electrical termination to a waveguide component. A further advantage is the mechanical rigidity that such a compact design provides which results in a robust system that can further help reduce parasitic interference otherwise caused by the connector. Further, by electrically connecting the connector directly to the electrical termination, rather than by a coaxial cable, the insertion loss is reduced by removing the insertion loss arising from the cable itself and also the insertion loss arising from the connectors on the cable and the connector which otherwise would be present at the electrical device. Another advantage of the present invention is its simple construction.

The substantially flat portion on the rear side can provide a mating surface forming a secondary electrical connection between the connector and the housing. This secondary electrical connection is in addition to that of the electrical terminator and the electrical connector and can be used to provide an earth connection between the electrical housing and the waveguide component.

The antenna is designed to interact with an electromagnetic wave which can be transmitted by the waveguide component. For example, the antenna can propagate an electromagnetic wave or it may receive an electromagnetic wave.

The body can comprise a first plate and a second plate. The first plate can present the portion of substantially flat surface. The second plate can include the aperture part of the end launch transition. The plates can be assembled into the body. An attachment mechanism can be provided to secure the first and second plates together into a rigid body.

Using plates has advantages when assembling the body and connecting the body to the housing. The first plate and a second plate allow manufacture to be simpler. The first plate and second plate can be used to captivate the antenna within the body of the connector. Further, having two plates provides a device which can be assembled to include the antenna and electrical connector prior to being mounted to the housing. This can provide advantages in flexibility of construction.

The waveguide component can be any component which includes at least a part of a waveguide. Examples of waveguides include hollow waveguides, such as rectangular waveguides. The waveguide component can be capable of propagating a microwave frequency wave.

The transition can be a waveguide mode transition. The waveguide mode transition can be an end launch transition in which the antenna is perpendicular to the desired waveguide electric field.

The electrical connector and antenna can be formed from a single piece of conducting material, such as a metal. This has been found to provide simpler manufacturing and construction of the device. Further, it reduces parasitic degradation of an electric signal.

The electrical connector can comprise a push-fit mechanism for coupling to the electrical terminator. Hence, the connector can quickly and simply be connected to an electrical terminator. The connector can also include at least one fastener to attach the connector to the housing. Thus, the connector can be rigidly connected to the housing. The push fit mechanism can be a male part or a female part.

The antenna can be held in a dielectric portion or component. The electrical connector can be held in a dielectric portion or component. The dielectric portion which holds the antenna can be the same as the dielectric portion which holds the electrical connector. The dielectric portion can comprise two parts. The electrical connector and antenna can be held within the two parts.

The push-fit mechanism of the connector can include a dielectric collar. The dielectric collar can snugly receive a female part of the electrical connector to form part of the push fit mechanism. The dielectric collar can mateably connect with an aperture in the first plate.

The body can comprise at least one formation for receiving at least one fastener for attaching the transition to the housing. The formation can be an aperture. The aperture can be threaded. The formation can be within the first plate only. The aperture can be accessed via the aperture in the second plate. Hence, a connecting mechanism, such as a bolt fastener, can be passed through the second plate and through the first plate for securing the transition to the housing.

The transition can include a mechanism for securing the first and second plates together into a rigid body. The mechanism can include a fastener. The fastener can be a threaded fastener which co-operates with apertures and a thread to secure the plates together.

The transition can comprise a third plate and the third plate can be sandwiched between the first and second plates.

The transition can comprise a tuning device for electrically tuning the transition with respect to the waveguide component. The tuning device can be in the form of a mechanically adjustable element. The mechanically adjustable element can be in the form of threaded component. The mechanically adjustable element can be at least partially located within the aperture of the second plate such that the electrical characteristics of the cavity can be altered. The threaded component can be a grub screw.

In a second aspect, the invention can provide a system having a housing containing an electrical device which includes an electrical terminator. The system can comprise the transition according to the first aspect of the invention. The system can also comprise a waveguide component. The waveguide component can be directly attached to the housing via the transition.

In the third aspect, the invention provides a method of connecting a wave guide component to an electrical housing which has an electrical terminator. The method can comprise mounting a rear side of a transition to the housing and coupling the electrical terminator to an electrical connector of the transition. The method can also comprise attaching a waveguide component to a front side of the transition.

The transition used in the method can comprise a first plate and a second plate. The method can further comprise connecting the first and second plates together prior to mounting the transition to the housing.

BRIEF DESCRIPTION OF THE DRAWINGS

Embodiments of the invention will now be described in detail, and by way of example only, with reference to the accompanying drawings, in which.

DETAILED DESCRIPTION OF THE PREFERRED EMBODIMENTS

Figure 1:
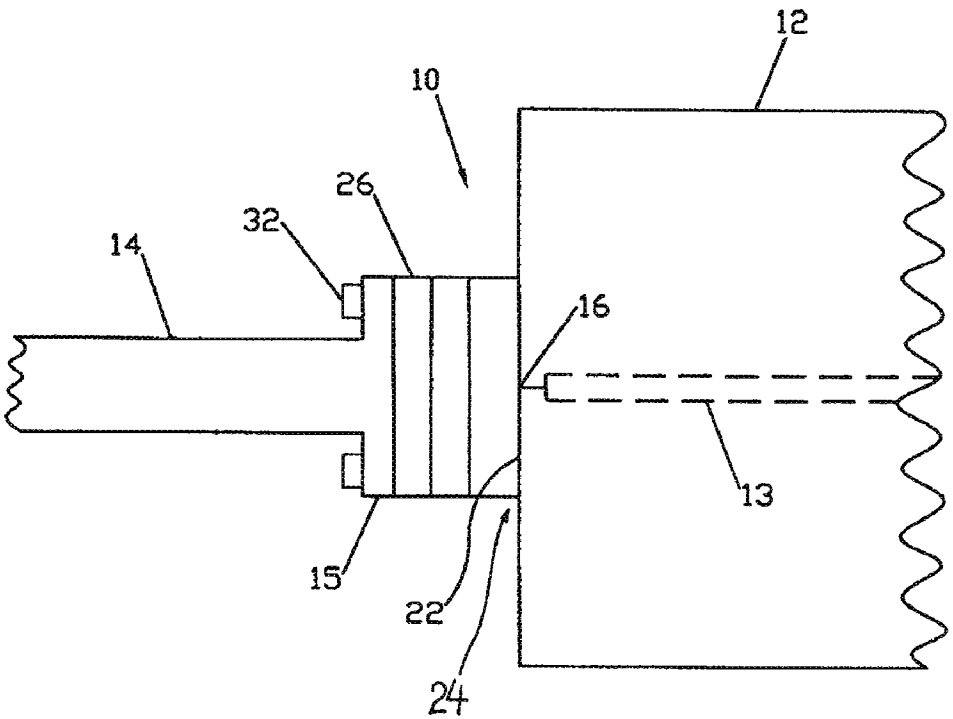
FIG. 1 shows a side view of an assembly comprising a waveguide component and a housing connected by a transition according to the invention.

FIG. 1 shows a side view of a housing (12) of an electronic device and a waveguide component in the form of a waveguide tube (14) attached to the housing by a transition (10) according to the invention, also sometimes referred to herein as a connector. A first embodiment of the transition is shown in greater detail in FIGS. 2 to 6.

The housing (12) houses an electrical device, for example circuit board (13) as illustrated in ghost lines, and includes a male electrical terminator (16) which stands proud (i.e., slightly projecting) from the end of the housing. The housing (12) can contain any type of electrical or electronic hardware or components which need to interact with electromagnetic components, such as waveguide components. For example, the electronic components may be amplification components used as part of a microwave base station. Typically, the housing (12) will be hermetically sealed to protect the electronic components within. The electrical terminator (16) can be any connector which can provide an electrical connection between the electronics within the housing (12) and the outside world. The terminator can be a male or female electrical connector. In an embodiment in which the electrical connector of the housing is female, then the connector is not proud of the housing but is exposed from the housing (12).

Figure 5:
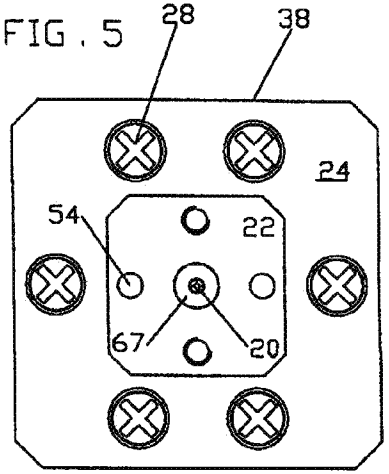
FIG. 5 shows a rear view of the transition.
Figure 4:
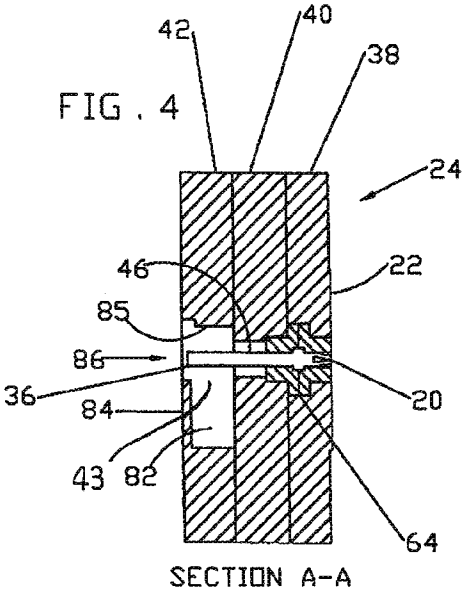
FIG. 4 shows a cross-sectional view along line AA' of the transition shown in FIG. 3.

The transition (10) abuts the end of the housing (12) via a substantially flat surface portion (22) on a rear side or face (24) (see also FIGS. 4 and 5). The rear side (24) of the transition (10) presents a female electrical connector (20), as shown in FIG. 4, which can be push-fit connected to the male terminator of the housing (12) to form an electrical connection between the electrical device and the transition.

The waveguide component (14) is a length of waveguide and is attached to the transition (10) via an attachment formation (26). The attachment formation (26) is in the form of four threaded holes in respective corners of the transition which receive bolts (32) passing through holes on an end plate (15) of the section of waveguide (14).

Figure 2:
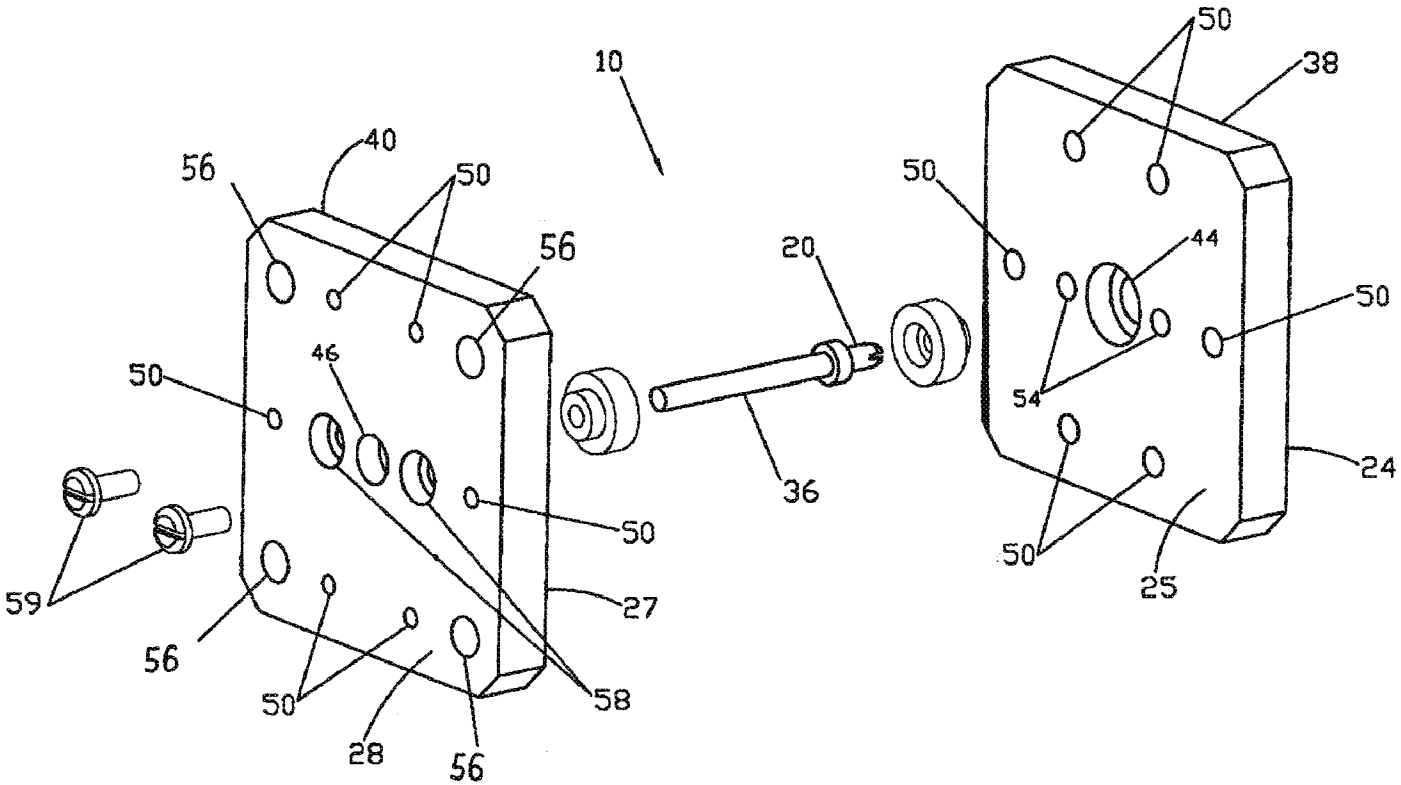
FIG. 2 shows an exploded perspective view of parts of a transition according to the invention.

An antenna (36) is located in the transition (10) as shown in FIG. 2, such that the it can either generate an electromagnetic field in the waveguide or generate an electrical signal in response to an electromagnetic field in the wave guide component (14). The antenna and electrical connector (20) are in electrical communication such that an electrical signal can pass between the electrical terminator (16) (shown in FIG. 1) and the transition (10).

The waveguide component (14) can be any component known in the art which is part of a waveguide or which connects to a waveguide. As illustrated in FIG. 1, the waveguide component can be a section of hollow waveguide, such as a rectangular waveguide. Typically, the transition (10) can be used in waveguide systems which operate in the frequency range of approximately 3 GHz to 60 GHz or generally in the microwave frequency region of the electromagnetic spectrum.

FIG. 2 shows an exploded perspective view of parts of the transition (10). The transition has a body in the form of three plates. A first plate (38) forms the rear side (24) of the transition (10) and includes a mechanism for securing the connector to the housing. The third plate (40) has a similar size and shape to the first plate and includes various apertures and formations for interacting with the other parts of the component as will be described in greater detail below. The shape of the first and third plates will be dictated by the mechanical fastening required of the housing (12) and the size and shape of the waveguide component (14) to be connected as shown in FIG. 1. In this embodiment the first plate (38) and third plate (40) are generally square. The thickness of the plates is such that the electrical connector (20) and antenna (36) and the fasteners can be accommodated. This will be dependent on the details of the electrical terminator (16) to which the transition is to connect and the waveguide component (14).

Figure 3:
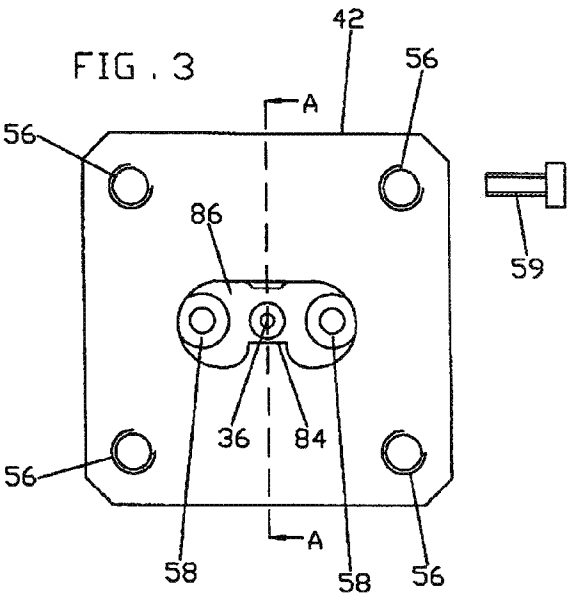
FIG. 3 shows a front view of the transition according to the invention.

A second plate (42) is also provided which is configured to co-operate with the antenna (36) so as to act as an end launch transition for a waveguide component as shown in FIGS. 3 and 4.

The first plate 38 has a front side 25 and a rear side 24 and the third plate 40 has a front side 28 and a rear side 27. Co-axial apertures (44, 46) pass through the centre of the first plate and third plate and provide a cavity for locating the antenna (36) and electrical connector (20) component. The diameter of the coaxial apertures (44, 46) will affect the impedance of the antenna (36) and electrical connector (20). This is a design consideration dependent on a number of factors as will be understood by a person skilled in the art.

The first plate (38) and third plate (40) are configured to be mechanically attached together. In order to achieve this, six corresponding fixing apertures (50) are provided in the first plate (38) and third plate (40) with corresponding blind threaded holes in the first plate, to receive six fasteners (28) in the form of bolts, as shown in FIG. 5. The fixing apertures (50) in the first plate (38) are also counterbored on the rear side (24) to provide a recess to accommodate the head of a bolt. Thus, bolts passed through the fixing apertures (50) of the first plate (38) can be engaged with the threaded fixing apertures of the second plate (42), as shown in FIGS. 3 and 4, to secure the three plates together in a 'sandwich' structure. Once tightened, the heads of the bolts will rest below the level of the substantially flat surface (22) on the rear side (24) of the first plate (38) so as not to foul the housing (12) when the device is attached in use. The fixing apertures (50) are located towards the peripheral edge of the plates such that they are distanced from the electrical connector (20) and antenna (36). This helps reduce any electrical interference with the transmitted or received signals when in use.

The skilled person will appreciate that in other embodiments, different mechanisms can be used to secure the plates together. For example, clips, clamps, clasps or pins can be used to achieve a mechanical coupling or various types of adhesive can be used to secure the plates together without using a separate mechanical fixing, such as adhesives, e.g. a conductive epoxy, or soldering.

As illustrated in FIGS. 1, 2 and 4, the first plate (38) directly abuts the housing (12) via a portion of substantially flat surface (22) defined on the rear side (24) of the first plate (38). The substantially flat surface (22) does not have to cover the entire rear side (24) of the first plate (38) but should be sufficient to provide an appropriate mating surface for the purpose of providing a sound physical connection. In the illustrated embodiment the substantially flat surface (22) only covers a central portion of the rear side (24) of the first plate (38). Also, the substantially flat surface (22) sits proud of (i.e., slightly projecting from) the rear surface of the first plate (38) as shown in FIG. 4. This helps to provide a surface which is clear of any surroundings which may foul the mating of the transition (10) to the housing (12). In other embodiments, the substantially flat surface may be defined in other ways, for example by being a different shape, having a different location and/or by comprising more than one portion. For example, the substantially flat surface may be defined by a plurality of short formations extending from the rear of the first plate having free ends whose positions define the substantially flat surface.

Returning to FIG. 2, in addition to the apertures (50) for holding the connector together, further pairs of co-axial apertures (54, 58) are provided in the first plate (38) and third plate (40) to accept fasteners in the form of bolts 59 for mechanically securing the transition (10) to the housing (12). The housing (12) is provided with corresponding threaded holes (not shown) to accept the bolts. This provides a mechanism for securing the transition to the housing.

The apertures in the first and third plates are co-axial and pass through the plates. The position of the attaching apertures are such that they pass through the substantially flat surface (22) on the rear side (24) of the third plate (40), one on either side of the central apertures (44, 46). The proximity of the attaching apertures (54) to the central apertures (44, 46) improves the coupling of the substantially flat surface (22) to the housing (12) and the electrical connector to the electrical termination. The apertures 58 have a larger diameter than the apertures 54 in order to accommodate the heads of the bolts 59.

Because the heads of the bolts 59 are positioned relatively close to the central aperture (46) which receives the antenna (36), unless correctly positioned, the heads of the bolts would cause interference in the transmitted or received electromagnetic wave. To reduce or eliminate the effect of this potential interaction, the apertures 58 in the third plate (40) are made sufficiently wide and deep to accept the head of the bolt and the apertures 54 in the first plate (38) are of sufficient size to accept the shaft of the bolt only. Hence, when the bolts 59 are passed through the first and third plate (40) and screwed into the housing, the underside of the bolt head can contact the front side 25 of the first plate (38) and clamp the transition (10) against the housing. Also, as illustrated best in FIG. 3, the aperture (56) in the second plate provides access to the bolt heads allowing a tool to be used to screw the bolts into the threaded apertures of the housing with the connector plates already assembled. Typically the inference created by the bolts will become less significant the lower the operating frequency of the waveguide component (14).

Figure 6:
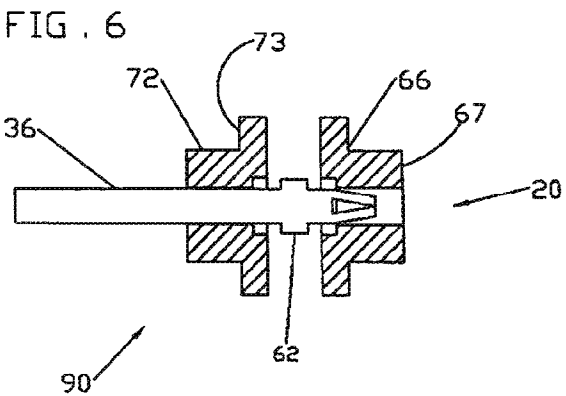
FIG. 6 shows a cross section of an antenna part of the transition.

FIG. 6 shows a cross section of the electrically active component (90) which includes a part providing the electrical connector (20) and a part providing the antenna (36). The electrical connector (20) provides a push-fit electrical connection between the electrical terminator (16) of the housing (12), as shown in FIG. 1, and the antenna (36). The electrical connector (20) is a female connector and comprises a hollow cylindrical portion which is configured to mateably engage with the male connector of the electrical terminator (16). The hollow cylinder of the electrical connector (20) has slits running along its length so that a plurality of resiliently deformable prongs are formed. As the electrical connector (20) mates with the electrical terminator (16), the prongs resiliently deform to accept the male portion and provide an electrical connection.

The antenna (36) is a circular, cylindrical length of metal that protrudes from the third plate (40) so as to be exposed in cavity 43 formed in the second plate (42) as part of the end launch transition, as shown in FIG. 4. Several design factors will influence the size and shape of the antenna (36) and the amount that it protrudes from the third plate (40).

The electrically active component (90) is formed from a single piece of metal as shown in FIG. 6. An annular ring (62) of metal is located along the length of the electrically active component 90 to help secure the electrically active component in the transition (10).

The electrically active component includes a dielectric part (64) as shown in FIG. 4. The dielectric part 64 provides support to the antenna (36) and electric connector such that it is held relative to the first and second plates and also ensures that the correct impedance is presented by the electrical connector 20. The dielectric portion is made from two parts. The first dielectric part 66 is housed within aperture 44 of the first plate (38) and is in the form of a first collar. The first dielectric collar (66) comprises two coaxial cylinders having different diameters so that the first collar (66) has a T-shaped cross-section along the longitudinal axis. A hole passes through the first collar (66) along a longitudinal axis thereof and is of sufficient diameter to snugly accept the electrical connector (20). The end of the hole which emerges from the broader part of the first collar (66) is counterbored to accept a portion of the annular ring (62). Hence, the when the electrical connector (20) is located in the first collar, the annular ring (62) abuts the shoulder of the counterbored portion so that the end of electrical connector (20) is flush with the rear side (24) of the first collar. When the electrical connector (20) is held within the first collar (66) and mated to the electrical terminator (16), the first collar (66) acts to prevent the prongs of the female part expanding too far so as to deteriorate the surface contact between the electrical connector (20) and terminator. This improves the connection between the electrical connector (20) and electrical terminator (16). The rear end 67 of the dielectric component 66 is presented at the rear of the connector to improve coupling to the electrical terminator (16) of the housing.

The second part 72 of the dielectric component is similar to the first part in that it comprises two coaxial cylinders having different diameters so that the second collar (72) has a T-shaped cross-section along the longitudinal axis. A hole passes through the second collar (72) along the longitudinal axis thereof and is of sufficient diameter to snugly accept the antenna (36). The end of the hole which emerges from the broader part of the second collar (72) is counterbored to accept a portion of the annular ring (62). Hence, the when the antenna (36) is located in the second collar (72), the annular ring (62) abuts the shoulder of the counterbored portion so that the antenna (36) protrudes from the dielectric portion the required amount. The relationship between the counterbores of the holes in the first and second portions and the annular ring (62) of the electrically active component 90 is such that when assembled, the annular ring (62) is snugly held by the dielectric portion.

The central aperture 44 in the first plate (38) which accepts the electrical connector (20) has a diameter which can snugly accept the narrower diameter of the first collar (66). The aperture is counterbored to accept the broader portion of the collar. The depth of the counterbore is also sufficient to accept the broader part of the second collar (72). Hence, when assembled the outer face 73 of the broader part of the second dielectric portion is flush with the front side 25 (FIG. 2) of the plate. The central aperture in the second plate (40) is of sufficient diameter to accept the narrow portion of the second collar (72) only. The size of this diameter, and that of the dielectric portion determines the impedance of the antenna (36) and electrical connector (20). The skilled person will appreciate that this impedance will affect the matching of the transition (10) to the system in which it is used. Hence, the insertion loss associated with the connector can be controlled to an extent by choosing appropriate dimensions of the central aperture and dielectric parts.

The second plate (42) is configured to interact with the remainder of the transition so as to provide an end launch transition. The operation and properties of an end launch transition are described in detail in UK Patent No. 2338607B, the disclosure of which is hereby incorporated by reference for all purposes. The second plate (42) includes a cavity or aperture (82) within which the antenna (36) is located, as shown in FIG. 4. The dielectric portion holds the antenna (36) in a fixed position relative to the cavity (82) and a tongue (84), as shown in FIG. 4. Altering the distance that the antenna (36) extends into the cavity (82), the separation of the antenna (36) from the tongue (84) and width of the aperture (82) will alter the impedance of the transition (10). To allow this impedance to be tuned, a tuning device can be provided within the cavity. The tuning device can be in the form of a grub screw (a small headless screw) which can be screwed into the cavity from a portion (85) of the second plate above the antenna, as shown in FIG. 4. Screwing the grub screw into the cavity alters the impedance of the cavity allowing the circuit to be tuned.

As shown in FIG. 3, there are four threaded fixing apertures 56 at the corners of the second plate 42 which correspond to the fixing apertures in the first plate (38) and third plate (40). As shown in FIGS. 3 and 4, the end launch transition also has an aperture 86 in the centre of its front face which is large enough to allow the bolts, which couple the connector to housing, to pass through and through the apertures described above and provides access for a tool to screw the bolts in place.

The first, second and third plates can be made from any conductive material which is not ferro-magnetic. For example, they can be made from a metal or an alloy such as aluminium or brass. The electrical connector (20) can also be made from any suitably conductive material. However, given the female portion of the connector requires a certain amount of resilient deformation in order to operate as a push fit mechanism, a preferable material is a beryllium copper alloy which is reasonably springy. The person skilled in the art will appreciate there are other suitable materials for making the electrical connector (20) and antenna (36). The dielectric portion can be made from any dielectric material. The electrical characteristics of the material will affect the impedance of the antenna (36) and electrical connector (20). A suitable material must also provide suitable mechanical support for holding the antenna (36) in a fixed position relative to the waveguide transition (10). An suitable material is polytetrafluorethylene (PTFE). The bolts which are used to couple the first plate (38) and second plate (40) together, and the transition (10) to the housing (12) can be made from any material which is not ferromagnetic. A good example material is stainless steel.

To assemble the transition the electrical connector (20) is inserted into the first dielectric collar 66 until the annular ring (62) abuts the shoulder of the counterbored aperture. The second dielectric part 72 is then passed over the antenna (36) and pushed home until the first and second dielectric portions meet and the annular ring (62) is secured between the two. The electrical connector (20) is then passed into the central aperture 44 of the first plate (38) with the electrical connector (20) first so that it is flush with and exposed from the substantially flat portion of the rear side (24) of the first plate (38). The third plate (40) is then aligned and placed over the antenna (36) and second dielectric portion and pushed home so that the first plate (38) and third plate (40) come into contact. The electrically active component 90 is then held firmly within the connector body. Providing a part of the transition body in a two part form facilitates manufacturing and assembly of the transition.

The second plate is brought into registration with the remainder of the body of the transition and bolts 28 are passed from the rear side (24) of the first plate (38), as shown in FIG. 5, and screwed into the threaded blind holes (not shown) of the third plate (42) to mechanically secure the first, second and third plates together. The bolt heads are located in the counterbores of the first plate (38) such that they cannot block the fitting of the transition to the housing (12). The electrical connector can then be married with the electrical terminator and the transition push fitted into place so that the rear flat face 22 of the transition abuts a portion of the housing 12 as illustrated in FIG. 1. Once the connector has been pushed home and the substantially flat surface abuts the housing (12), the transition is secured to the housing bolts 59 passing through attaching apertures (58) in the front side (28) of the third plate (40), through the first plate via corresponding attaching apertures (54) before being screwed into corresponding threaded apertures in the housing (12).

Once the transition has been mounted to the housing (12), the waveguide component 14 can be attached to the transition by screwing bolts 32 into threaded apertures (56) and passing into corresponding apertures 55 at the corners of the third plate 40.

Figure 9:
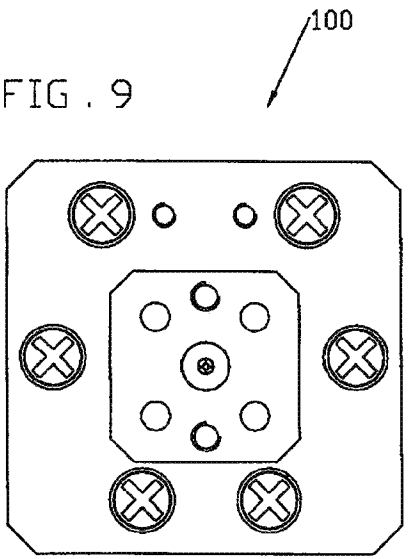
FIG. 9 shows a rear view of the transition shown in FIGS. 7 and 8.
Figure 8:
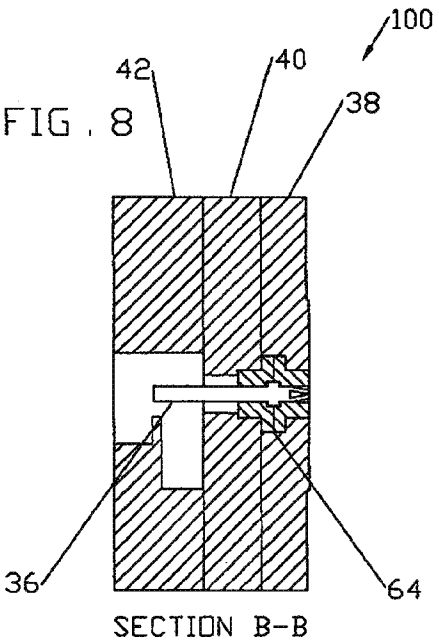
FIG. 8 shows a cross-sectional view along line BB' of the transition shown in FIG. 7.
Figure 7:
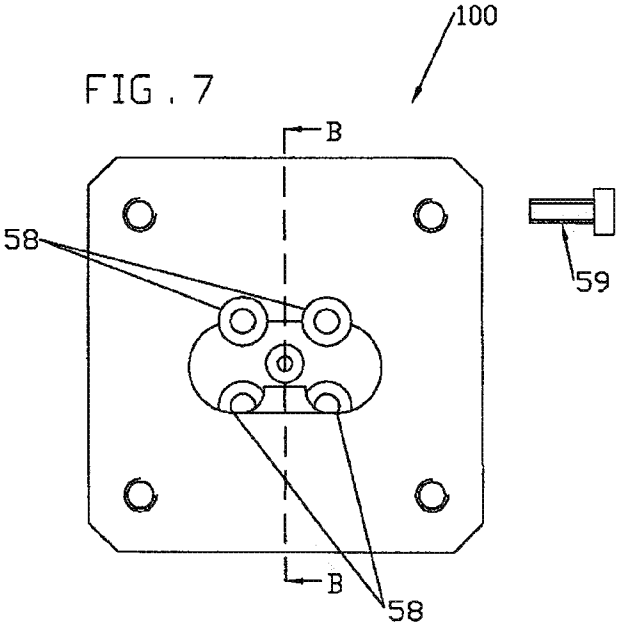
FIG. 7 shows a front view of a further embodiment of a transition according to the invention.

FIGS. 7 to 9 show a further embodiment of the transition 100 according to the invention. The transition is generally similar to the transition 10 described above and is suitable for use with larger waveguides. Where larger waveguides are used, it may be necessary to provide additional mechanical support. Further, the second plate is modified in order to provide the required coupling into the waveguide so that the transition can act as an end launch transition. FIGS. 7 to 8 show an embodiment of the transition in which the number of apertures 58 (in FIG. 7) for fixing the transition (10) to the housing (12) has been increased from two to four. The holes and method for fixing are the same as that described for previous embodiment. However, the depth of the heads of the bolts may need to be greater as the electromagnetic interference is likely to be greater for a greater number of screws.

Figure 11:
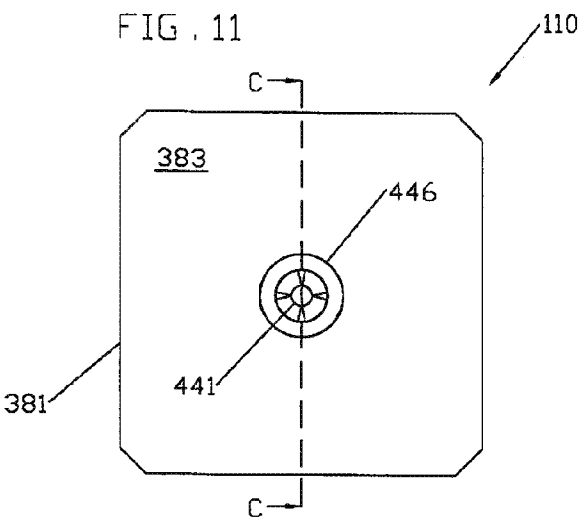
FIG. 11 shows a rear view of the transition shown in FIG. 10.
Figure 10:
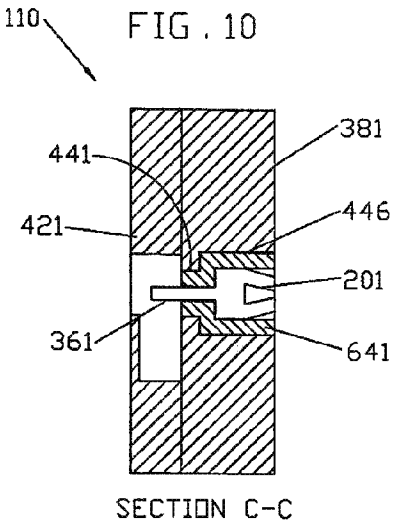
FIG. 10 shows a cross-sectional view of a further embodiment of a transition according to the invention.
Figure 12:
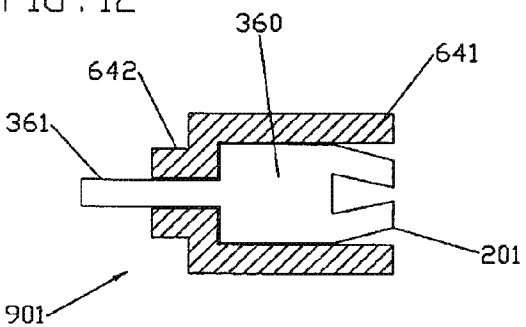
FIG. 12 shows a cross-sectional view of the antenna used in the transition shown in FIGS. 10 and 11.

FIGS. 10 to 12 show a further embodiment of a transition (110) according to the invention. FIG. 10 shows a cross section through the transition, FIG. 11 a view of a rear face of the transition and FIG. 12 a cross sectional view through an electrically active component 901 of the transition. The transition is generally similar in construction to the first and second embodiments and so is not described here in great detail. However, the significant differences from the first and second embodiments are described below. Instead of having a three plate construction, the body of the transition has a generally two plate construction. The first and third plates of the previous embodiments are replaced by a single first plate (381) to which a second plate (421) is attached. Plate (381) has concentric, co-axial apertures (441, 446), having a first and a second, larger diameter which define a cavity for receiving the electrically active component (901) in. The second plate (421) is similar to that described above.

As shown in FIG. 12, the electrically active component (901) has a body (360) with an antenna (361) extending from a first end and a push fit mechanism of the electrical connector (201) extending from a second end and which are also similar to those of the transition described above. However, the dielectric part (641) is made from a single piece of PTFE having two co-axial cylindrical portions. A first head portion (642), located at one end of the dielectric part (641), has a narrower diameter than the rest of the cylinder to form a shoulder there between. It also has an aperture for snugly receiving a pert of the antenna 361. The outer diameter of the head part is sized to be snugly received in the smaller diameter aperture (441) of the end plate (381). Hence, when the electrical active component (901) is located within the coaxial apertures (441, 446) of the plate (381), the corresponding shoulders of the dielectric part (641) and apertures (441, 446) mate to prevent the dielectric part passing through the plate.

The electrically active part is mechanically retained in the cavity in the end plate (381). This can be achieved in a variety of ways. For example, the dielectric jacket part 641 can be dimensioned so as to provide an interference fit or push fit within the cavity in the end plate. Alternatively, or additionally, a press in collet or washer can be provided to be pushed over the electrical connector so as to secure the component in the body of the connector. Additionally, or alternatively, a screw thread can be provided in the walls defining the larger cavity 446 which the jacket is pressed into and into which threads the PTFE material can then deform and flow so as to lock the component (901) in place in the body of the transition.

The electrically active component (901) is then captivated within the body of the transition by the housing of the electrical device when the transition is mounted to the housing of the electrical device by the substantially flat rear face (383) of the plate (381), as shown in FIG. 11.

This embodiment has the advantage that the electrically active component does not need to be captivated between the first and second plates and the annular ring (62) of the previous embodiment is not required. Hence, construction of the transition is simpler.

The plate 421 can be securely attached to the end plate 381 by soldering the two components together or joining them using an adhesive, such as an electrically conductive epoxy. The skilled person will understand that there will be other ways in which the plates can be securely attached to each other.

Although not shown in FIGS. 10 and 11, the transition also includes a mechanism for attaching the transition to the electrical device housing. For example, the plates (381, 421) can include apertures passing through them for receiving threaded bolts for fastening into threaded apertures in the device housing similarly to the other embodiments. Similarly plate (421), includes an attachment mechanism similar to that described above by which a waveguide can be attached to the transition.

Various of the features of the different embodiments can be combined with features of the other embodiments. The skilled person will realize that the above embodiments provide examples of the invention and that the invention is not restricted only to these examples.

What is claimed is:

1. A compact waveguide end launch transition for connecting a housing having an electrical terminator and a waveguide component, comprising:

a body, wherein the body has a rear side presenting at least a portion of a substantially flat surface to abut the housing and wherein the body has a front side having an aperture formed therein;

an antenna located within the body and configured to interact with the aperture to form an end launch transition; and an electrical connector in electrical communication with the antenna and exposed from the rear side of the body to connect directly to the electrical terminator, wherein the electrical connector comprises a push-fit mechanism for coupling to the electrical terminator, and wherein the push-fit mechanism is a female part.

2. The end launch transition as claimed in claim 1 wherein the body comprises a first plate and a second plate and wherein the first plate has the rear side which presents the substantially flat surface and the first and second plates are secured together to form the body.

3. The end launch transition as claimed in claim 2 wherein the second plate includes a formation for accepting at least one fastener, wherein the formation is configured to reduce electrical interference on the propagation of the electromagnetic wave that would otherwise be created by the at least one fastener.

4. The end launch transition as claimed in claim 2, wherein the second plate comprises at least one formation for receiving at least one fastener to attach the first plate and the second plate together.

5. The end launch transition as claimed in claim 4 and further comprising a third plate including at least one formation for receiving the at least one fastener, and in which the third plate is sandwiched between the first plate and the second plate.

6. The end launch transition as claimed in claim 1 wherein the antenna or electrical connector is held in a dielectric portion.

7. The end launch transition as claimed in claim 6, wherein the dielectric portion comprises two parts, and the electrical connector and the antenna are formed from a single component held within the two parts.

8. A system comprising:

the housing having an electrical device including the electrical terminator;

the end launch transition as claimed in claim 1; and the waveguide component; and wherein the waveguide component is attached directly to the housing by the end launch transition.

9. The end launch transition as claimed in claim 1, wherein the electrical connector includes a dielectric part, and at least a portion of the dielectric part is exposed from the rear side of the body and is flush with the portion of substantially flat surface.

10. The end launch transition as claimed in claim 1, wherein the body includes at least one attachment mechanism allowing a waveguide component to be attached to the front side of the body.

11. The end launch transition as claimed in claim 1, and further including at least one formation for attaching the end launch transition to the housing.

12. The end launch transition as claimed in claim 11 wherein the at least one formation includes a fastener aperture for receiving at least one fastener to attach the end launch transition to the housing.

13. The end launch transition as claimed in claim 12, wherein the fastener aperture is positioned so as to be accessible via the aperture in the front side.

14. The end launch transition as claimed in claim 1 wherein the electrical connector and the antenna are formed from a single piece of metal.

15. The end launch transition as claimed in claim 1 wherein the end launch transition is a waveguide mode transition in which the antenna is perpendicular to a direction of a desired waveguide electric field.

16. The end launch transition as claimed in claim 1 and further comprising a tuning device for electrically tuning the waveguide end launch transition.

17. A compact waveguide end launch transition for connecting a housing having an electrical terminator and a waveguide component, comprising:

a body, wherein the body has a rear side presenting at least a portion of a substantially flat surface to abut the housing and wherein the body has a front side having an aperture formed therein;

an antenna located within the body and configured to interact with the aperture to form an end launch transition;

an electrical connector in electrical communication with the antenna and exposed from the rear side of the body to connect directly to the electrical terminator; and at least one formation for attaching the end launch transition to the housing, wherein the at least one formation includes a fastener aperture for receiving at least one fastener to attach the end launch transition to the housing, the fastener aperture being positioned so as to be accessible via the aperture in the front side.

18. A system comprising:

the housing having an electrical device including the electrical terminator;

the end launch transition as claimed in claim 17; and the waveguide component; and wherein the waveguide component is attached directly to the housing by the end launch transition.

19. The end launch transition as claimed in claim 17 wherein the body comprises a first plate and a second plate and wherein the first plate has the rear side which presents the substantially flat surface and the first and second plates are secured together to form the body.

20. The end launch transition as claimed in claim 19, wherein the second plate comprises at least one formation for receiving at least one fastener to attach the first plate and the second plate together.

21. The end launch transition as claimed in claim 20 and further comprising a third plate including at least one formation for receiving the at least one fastener, and in which the third plate is sandwiched between the first plate and the second plate.

22. The end launch transition as claimed in claim 19 wherein the second plate includes a formation for accepting at least one fastener, wherein the formation is configured to reduce electrical interference on the propagation of the electromagnetic wave that would otherwise be created by the at least one fastener.

23. The end launch transition as claimed in claim 17 wherein the end launch transition is a waveguide mode transition in which the antenna is perpendicular to a direction of a desired waveguide electric field.

24. The end launch transition as claimed in claim 17 wherein the electrical connector and the antenna are formed from a single piece of metal.

25. The end launch transition as claimed in claim 17 wherein the electrical connector comprises a push-fit mechanism for coupling to the electrical terminator.

26. The end launch transition as claimed in claim 17 wherein the antenna or electrical connector is held in a dielectric portion.

27. The end launch transition as claimed in claim 26, wherein the dielectric portion comprises two parts, and the electrical connector and antenna form a single component held within the two parts.

28. The end launch transition as claimed in claim 17, wherein the electrical connector includes a dielectric part, and at least a portion of the dielectric part is exposed from the rear side of the body and is flush with the portion of substantially flat surface.

29. The end launch transition as claimed in claim 17, wherein the body includes at least one attachment mechanism allowing a waveguide component to be attached to the front side of the body.

30. The end launch transition as claimed in claim 17 and further comprising a tuning device for electrically tuning the waveguide end launch transition.

31. A compact waveguide end launch transition for connecting a housing having an electrical terminator and a waveguide component, comprising:

a body, wherein the body has a rear side presenting at least a portion of a substantially flat surface to abut the housing, wherein the body has a front side having an aperture formed therein, wherein the body comprises a first plate and a second plate, and wherein the first plate has the rear side which presents the substantially flat surface and the first and second plates are secured together to form the body;

an antenna located within the body and configured to interact with the aperture to form an end launch transition; and an electrical connector in electrical communication with the antenna and exposed from the rear side of the body to connect directly to the electrical terminator, wherein the second plate includes a formation for accepting at least one fastener, and wherein the formation is configured to reduce electrical interference on the propagation of the electromagnetic wave that would otherwise be created by the at least one fastener.

32. The end launch transition as claimed in claim 31, further comprising a tuning device for electrically tuning the waveguide end launch transition.

33. A system comprising:

the housing having an electrical device including the electrical terminator;

the end launch transition as claimed in claim 31; and the waveguide component; and wherein the waveguide component is attached directly to the housing by the end launch transition.

34. The end launch transition as claimed in claim 31, wherein the end launch transition is a waveguide mode transition in which the antenna is perpendicular to a direction of a desired waveguide electric field.

35. The end launch transition as claimed in claim 31, wherein the formation attaches the first plate and the second plate together.

36. The end launch transition as claimed in claim 35, further comprising a third plate including at least one formation for receiving the at least one fastener, and in which the third plate is sandwiched between the first plate and the second plate.

37. The end launch transition as claimed in claim 31 wherein the electrical connector and the antenna are formed from a single piece of metal.

38. The end launch transition as claimed in claim 31, wherein the electrical connector comprises a push-fit mechanism for coupling to the electrical terminator.

39. The end launch transition as claimed in claim 31, wherein the antenna or electrical connector is held in a dielectric portion.

40. The end launch transition as claimed in claim 31, wherein the dielectric portion comprises two parts, and the electrical connector and antenna form a single component held within the two parts.

41. The end launch transition as claimed in claim 31, wherein the electrical connector includes a dielectric part, and at least a portion of the dielectric part is exposed from the rear side of the body and is flush with the portion of substantially flat surface.

42. The end launch transition as claimed in claim 31, wherein the body includes at least one attachment mechanism allowing a waveguide component to be attached to the front side of the body.

43. The end launch transition as claimed in claim 31, and further including at least one formation for attaching the end launch transition to the housing.

44. The end launch transition as claimed in claim 43, wherein the at least one formation includes a fastener aperture for receiving at least one fastener to attach the end launch transition to the housing.

* * * * *